US006919524B2

(12) United States Patent
Imamura et al.

(10) Patent No.: US 6,919,524 B2
(45) Date of Patent: Jul. 19, 2005

(54) MOVABLE CONTACT ASSEMBLY AND REMOTE CONTROLLER WITH ASSEMBLY

(75) Inventors: Yasuhiro Imamura, Tsuruga (JP); Isao Nozoe, Tsuruga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/890,860

(22) Filed: Jul. 14, 2004

(65) Prior Publication Data

US 2005/0061650 A1 Mar. 24, 2005

(30) Foreign Application Priority Data

Sep. 22, 2003 (JP) ..... 2003-329635

(51) Int. Cl.[7] ..... H01H 13/70
(52) U.S. Cl. ..... 200/512
(58) Field of Search ..... 200/511–517, 341, 200/5 A, 345

(56) References Cited

U.S. PATENT DOCUMENTS 4,186,638 A * 2/1980 Iijima ..... 84/655
4,636,593 A * 1/1987 Novak et al. ..... 200/5 A
5,521,342 A * 5/1996 Bartley et al. ..... 200/5 A
5,661,279 A * 8/1997 Kenmochi ..... 200/314
5,664,667 A * 9/1997 Kenmochi ..... 200/314
6,084,190 A * 7/2000 Kenmochi ..... 200/341

FOREIGN PATENT DOCUMENTS

JP 03-173198 A 7/1991

* cited by examiner

*Primary Examiner*—Michael A. Friedhofer
(74) *Attorney, Agent, or Firm*—RatnerPrestia

(57) ABSTRACT

A movable contact assembly includes a base having a sheet shape having a first surface and a second surface opposite the first surface, an operation portion projecting from the first surface of the base, an elastic portion having a domical shape and a elasticity for connecting the second surface of the base to the operation portion, and a contact on the operation portion. The operation portion has a surface facing in a facing direction identical to a facing direction of the second surface of the base. The surface of the operation portion is positioned in a direction with reference to the second surface of the base, and the direction is directed from the second surface of the base towards the first surface of the base. The operation portion projects from the first surface of the base. The elastic portion connects the second surface of the base to the operation portion. The elastic portion is thinner than the base. A remote controller including the movable contact assembly is thin and is manipulated.

4 Claims, 2 Drawing Sheets

MOVABLE CONTACT ASSEMBLY AND REMOTE CONTROLLER WITH ASSEMBLY

FIELD OF THE INVENTION

The present invention relates to a remote controller for remotely controlling various electronic devices, such as a television receiver, VCR, and air conditioner, and to a movable contact assembly to be used in the controller.

BACKGROUND OF THE INVENTION

Various electronic devices, such as a television receiver, VCR, and air conditioner, have been demanded to have various functions, small, and thin, and reliably-operable remote controller is accordingly demanded for remotely controlling these devices.

A conventional movable contact assembly used in a conventional remote controller will be described. FIG. 3 is a sectional view of the conventional remote controller. Movable contact assembly 1 includes a base 1A having a sheet shape and made of elastic material, such as rubber, operation portions 1B projecting upward, and elastic portion 1C which has a dome shape and connects upper surface 1E of base 1A to lower surface 1D of operation portion 1B. Operation portion 1B has lower surface 1G having movable contact 2 thereon made of conductive material, such as carbon. Elastic portion 1C is thinner than base 1A. Lower surface 1F of base 1A of movable contact assembly 1 is placed on wiring board 3 having plural wiring patterns (not illustrated) on upper and lower surfaces of board 3. plural fixed contacts 4 facing movable contact 2 of movable contact assembly 1 by a predetermined gap are provided on upper surface 3A of wiring board 3. Electronic components, such as LED 5A and microprocessor 5B, are mounted on lower surface 3B of wiring board 3. Fixed contacts 4 are electrically connected to each other with movable contact 2 by an operation to movable contact assembly 1. The electronic components provide control circuit 5 for transmitting signals for remote control in response to the electrical connection. Case 6 having a substantial box-like shape and made of insulating resin has open holes 6A through which operation portions 1B of movable contact assembly 1 project upward movably, respectively. Case 6 accommodates movable contact assembly 1 and wiring board 3. The lower surface of wiring board 3 is covered with cover 7 made of insulating resin, thus providing a remote controller.

The remote controller having the above-mentioned structure is directed to an electronic device, such as a television receiver, a VCR, or an air conditioner. Predetermined operation portion 1B for power supply switching or volume control is depressed with, for example, a finger, and elastic portion 1C elastically deforms accordingly. Accordingly, operation portion 1B moves downward, and movable contact 2 contacts fixed contacts 4 on wiring board 3. Signals, such as infrared rays, for the remote control corresponding to this operation are transmitted from control circuit 5 to the electronic device, thereby remotely controlling the device to turn on/off the device and control a volume.

The finger is released off from operation portion 1B to remove an operation force causes elastic portion 1C to return to the original, domical shape by its elastic force. Operation portion 1B accordingly moves upward, and then, movable contact 2 is removed away from fixed contacts 4, hence allowing them to return to the status shown in FIG. 3.

In the conventional remote controller, elastic portion 1C elastically deforming upon being depressed is positioned between upper surface 1E of base 1A and operation portion 1B. This arrangement provides clearance 6B between lower surface 6A of case 6 and upper surface 1E of base 1A. Gap 6B is equal to the height of elastic portion 1C, hence making the remote controller thick.

SUMMARY OF THE INVENTION

A movable contact assembly includes a base having a sheet shape having a first surface and a second surface opposite the first surface, an operation portion projecting from the first surface of the base, an elastic portion having a domical shape and a elasticity for connecting the second surface of the base to the operation portion, and a contact on the operation portion. The operation portion has a surface facing in a facing direction identical to a facing direction of the second surface of the base. The surface of the operation portion is positioned in a direction with reference to the second surface of the base, and the direction is directed from the second surface of the base towards the first surface of the base. The operation portion projects from the first surface of the base. The elastic portion connects the second surface of the base to the operation portion. The elastic portion is thinner than the base.

A remote controller includes the movable contact assembly, a board on which the second surface of the base placed, a second contact provided on the surface of the substrate, the second contact facing the first contact by a distance, a circuit provided on the substrate, for transmitting a signal according to a contact between the first contact and the second contact, and case for covering the contact assembly and the board. The case contacts the first surface of the base. The case has an open hole provided therein through which the operation portion of the contact assembly projects.

The remote controller including the movable contact assembly is thin and is manipulated.

DESCRIPTION OF THE PREFERRED EMBODIMENT

Figure 1:
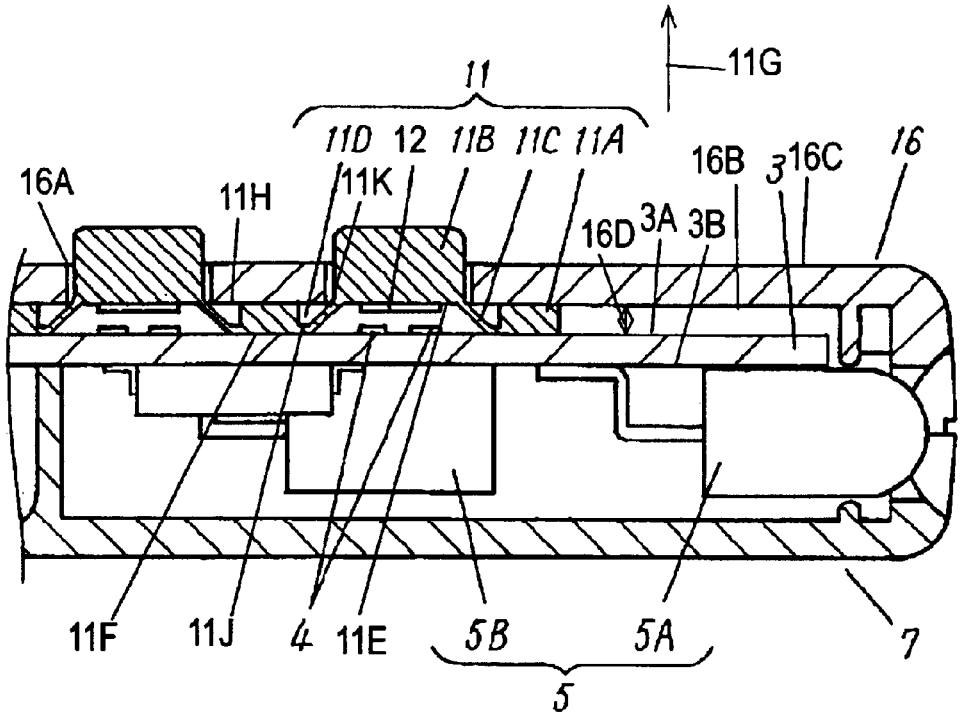
FIG. 1 is a sectional view of a movable contact assembly and a remote controller including the assembly according to an exemplary embodiment of the present invention.
Figure 2:
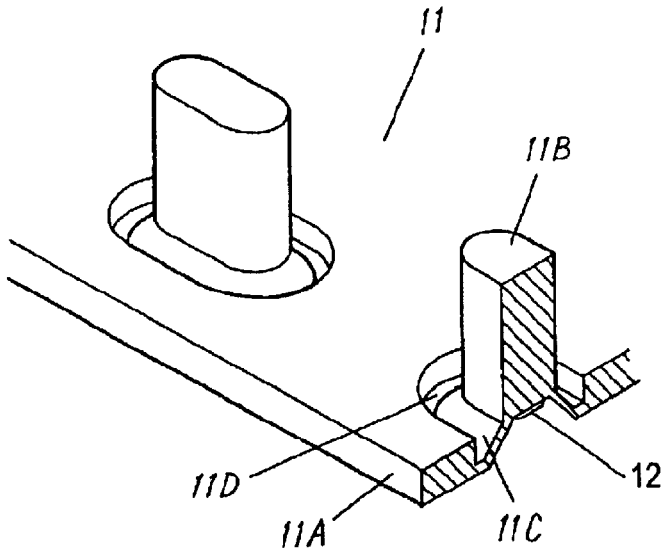
FIG. 2 is a perspective sectional view of the movable contact assembly according to the embodiment.

FIG. 1 is a sectional view of movable contact assembly 11 and a remote controller including assembly 11 according to an exemplary embodiment of the present invention. FIG. 2 is a perspective sectional view of assembly 11. Movable contact assembly 11 includes base 11A having a sheet-like shape, operation portion 11B projecting in direction 11G, and elastic portion 11C having a domical shape connecting base 11A and operation portion 11B. Base 11A is made of elastic material, such as silicone rubber or elastomer. Operation portion 11B has lower surface 11E having movable contact 12 thereon made of conductive material, such as carbon. Elastic portion 11C is thinner than base 11A. Groove 11D is provided on an upper surface of base 11A at the outer edge of elastic portion 11C. Elastic portion 11C connects lower surface 11F of base 11A and lower surface 11E of operation portion 11B. Namely, end 11J of elastic portion 11C is connected to lower surface 11F of base 11A, and end 11K of elastic portion 11C is connected to lower surface 11E of operation portion 11B. Lower surface 11E of operation portion 11B faces in a facing direction identical to a facing direction of lower surface 11F of base 11A. Lower surface 11E of operation portion 11B is positioned in a direction with reference to lower surface 11F of base 11A, and the direction is directed from lower surface 11F of base 11A towards upper surface 11H of base 11A. Operation portion 11B projects from upper surface 11H of base 11A. Wiring board 3 made of insulating material, such as paper phenol or glass epoxy, has wiring patterns (not illustrated) made of conductive material, such as copper, on its upper and lower surfaces. Lower surface 11F of base 11A is placed on upper surface 3A of wiring board 3. Upper surface 3A of wiring board 3 has fixed contacts 4 thereon which are distance from each other by a predetermined distance and face movable contact 12 of movable contact assembly 11. Electronic components, such as LED 5A and microprocessor 5B, are mounted on lower surface 3B of wiring board 3. Fixed contacts 4 are electrically connected with movable contact 12 through an operation to movable contact assembly 11. The electronic components provide control circuit 5 for transmitting signals for remote control according to the electrical connection. Case 16 having a substantially box-like shape and made of insulating resin, such as polystyrene or ABS, has open holes therein through which operation portions 11B of movable contact assembly 11 project upward movably. Case 16 accommodates movable contact assembly 11 and wiring board 3.

Elastic portion 11C deforming elastically upon being depressed is positioned between lower surface 11F of base 11A and lower surface 11E of operation portion 11B. This arrangement prevents elastic portion 11C from projecting from upper surface 11H of base 11A. Accordingly, clearance 16D between lower surface 16B of case 16 and upper surface 3A of wiring board 3 is substantially equal to the thickness of base 11A.

Figure 3:
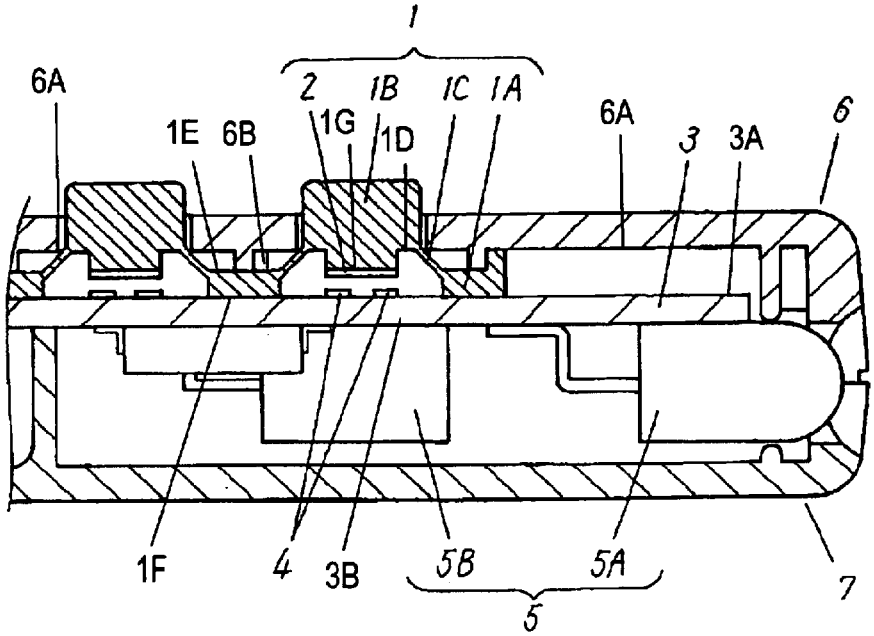
Fig. 3 PRIOR ART
FIG. 3 is a sectional view of a conventional remote controller.

Consequently, the height from upper surface 3A of wiring board 3 to upper surface 16C of case 16 is equal to the sum of respective thicknesses of case 16 and base 11A. Accordingly, the remote controller according to the embodiment can be thinner than a conventional remote controller shown in FIG. 3.

The remote controller having the above-mentioned structure is directed to an electronic device, such as a television receiver, a VCR, or an air conditioner. Predetermined operation portion 11B for power supply switching or volume control is depressed with, for example, a finger, and elastic portion 11C elastically deforms accordingly. Accordingly, operation portion 11B moves downward, and movable contact 12 contacts fixed contacts 4 on wiring board 3. Signals, such as infrared rays, for the remote control corresponding to this operation are transmitted from control circuit 5 to the electronic device, thereby remotely controlling the device to turn on/off the device and control a volume.

The finger is released off from operation portion 11B to remove an operation force causes elastic portion 11C to return to the original, domical shape by its elastic force. Operation portion 11B accordingly moves upward, and then, movable contact 12 is removed away from fixed contacts 4, hence allowing them to return to the status shown in FIG. 1.

What is claimed is:

1. A movable contact assembly comprising:

a base having a sheet shape having a top surface and a bottom surface, the bottom surface facing in a facing direction;

an operation portion having a bottom surface facing in the facing direction of the bottom surface of the base, the bottom surface of the operation portion being positioned above the top surface of the base;

an elastic portion having a domical shape and a elasticity, the elastic portion being thinner than the base, the elastic portion connecting the bottom surface of the base to the operation portion; and a contact on the bottom surface of the operation portion.

2. The movable contact assembly of claim 1, wherein the base includes elastic material.

3. A remote controller comprising:

a contact assembly including a base having a sheet shape having a top surface and a bottom surface, the bottom surface facing in a facing direction, an operation portion having a bottom surface facing in the facing direction of the bottom surface of the base, the surface of the operation portion being positioned above the top surface of the base;

an elastic portion having a domical shape and a elasticity, the elastic portion being thinner than the base, the elastic portion connecting the bottom surface of the base to the operation portion, and a first contact on the bottom surface of the operation portion;

a board on which the bottom surface of the base placed;

a second contact provided on a surface of the board, the second contact facing the first contact by a distance;

a circuit provided on the board, for transmitting a signal according to a contact between the first contact and the second contact; and a case for covering the contact assembly and the board, the case contacting the top surface of the base, the case having an open hole provided therein through which the operation portion of the contact assembly projects.

4. The remote controller of claim 3, wherein the base of the contact assembly includes elastic material.

* * * * *